US006785984B2

(12) United States Patent
Jackinsky

(10) Patent No.: US 6,785,984 B2
(45) Date of Patent: Sep. 7, 2004

(54) WALKING SHOE

(76) Inventor: Carmen U. Jackinsky, 18815 SW. Honeywood Ct., Aloha, OR (US) 97006

( * ) Notice: Subject to any disclaimer, the term of this patent is extended or adjusted under 35 U.S.C. 154(b) by 34 days.

(21) Appl. No.: 10/223,774

(22) Filed: Aug. 19, 2002

(65) Prior Publication Data

US 2003/0033732 A1 Feb. 20, 2003

Related U.S. Application Data

(60) Provisional application No. 60/313,065, filed on Aug. 17, 2001.

(51) Int. Cl.[7] ..... A43B 13/18; A43B 13/16; A43B 13/22

(52) U.S. Cl. ..... 36/28; 36/102; 36/103; 36/31

(58) Field of Search ..... 36/28, 102, 103, 36/30 R, 31, 44

(56) References Cited

U.S. PATENT DOCUMENTS 4,316,332 A * 2/1982 Giese et al. ..... 36/30 R
4,372,059 A * 2/1983 Ambrose ..... 36/30 R
4,638,576 A * 1/1987 Parracho et al. ..... 36/30 R
4,757,620 A * 7/1988 Tiitola ..... 36/30 R
5,592,757 A * 1/1997 Jackinsky ..... 36/31
5,718,064 A * 2/1998 Pyle ..... 36/44
5,727,335 A * 3/1998 Kousaka et al. ..... 36/30 R
6,625,905 B2 * 9/2003 Kita ..... 36/30 R

* cited by examiner

*Primary Examiner*—Anthony Stashick
(74) *Attorney, Agent, or Firm*—Kolisch Hartwell, P.C.

(57) ABSTRACT

A walking shoe. According to one aspect of the present invention, a walking shoe includes a segmented midsole with a thickness that changes from back to front. The midsole includes a back portion and an arcuate front portion. The arcuate front portion interfaces with the back portion and includes a plurality of forward sections. At least one of the forward sections differs in density relative to another of the forward sections. Relatively denser forward sections facilitate a rebound or spring effect as a walker pushes off during a walking stride. Relatively less dense forward sections add cushioning, making the walking stride more comfortable by lessening impact to the walker's foot.

10 Claims, 1 Drawing Sheet

WALKING SHOE

CROSS-REFERENCE TO RELATED APPLICATIONS

This application is based upon and claims priority under 35 U.S.C. §119 from the following co-pending provisional patent application, which is incorporated herein by this reference, in its entirety and for all purposes: WALKING SHOE, Ser. No. 60/313,065, filed Aug. 17, 2001.

TECHNICAL FIELD

The present invention relates generally to footwear, and more particularly, to a shoe sole that has been adapted to improve a walker's power, posture, and comfort. This is accomplished by a unique sole arrangement, which optimizes shoe cushioning and spring or rebound. Although the shoe provides benefits which extend to all forms of footwear, it has proven especially effective for use by people who walk for exercise and/or competition, and is described in the context of race walking below.

BACKGROUND OF THE INVENTION

In recent years, there has been an explosion in the physical fitness industry, and correspondingly, in the desire for equipment which improves an individual's performance of activities which promote good health. One area which has experienced particular growth involves low-impact cardiovascular exercise, an endeavor known to improve physical condition without unduly taxing an individual's joints. Activities such as walking have thus popularized, and have developed into competition sports such as performance walking or race walking. The sport serves as an increasingly popular form of exercise and recreation, attracting persons of differing levels of skill and physical ability. The fitness industry, however, has been slow in recognizing this trend, and has yet to develop an acceptable walking shoe. Walkers have thus been forced to make do with running shoes, shoes designed to accommodate a high impact activity which requires very different foot posture, stride technique, impact absorption, and overall shoe use from that of performance walking or race walking.

Walking technique consists of a series of steps, where each step constitutes a cycle in which the walker shifts from a single support phase, to a double support phase, and then back to the single support phase. In the single support phase, the walker's entire weight is balanced on one foot, the other foot being moved forward so as to move the walker into the double support phase. In the double support phase, the walker's weight is balanced between a leading and a trailing foot. The trailing foot is used to push the walker forward so as to again enter the single support phase, and begin the cycle anew. The aforementioned "push-off" begins during the single support phase when the walker's center of gravity passes over the supporting foot. The walker, at all times, has at least one foot in contact with the ground, reducing the impact associated with each step, and resulting in an overall lower impact exercise routine.

With each step in the stride phase, the athlete's forward foot lands on the heel ("heel strike"), and moves forward to a planted position with the heel and ball of the foot supported from below. The ball of the foot acts as a fulcrum, the walker's foot pivoting forward about the fulcrum as the walker's center of gravity passes thereover. This accommodates push-off by the walker's toes. The walker does not push-off with the trailing foot until the leading foot is planted so as to provide the walker with stable support. A slight forward lean of approximately 5 degrees from vertical provides the walker with an ideal walking posture and helps with forward momentum. Such lean should be from the ankles, rather than from the waist because a forward bend from the waist shortens the walker's stride and compromises breathing power by cramping the person's lungs.

In conventional shoes, the wearer's heel is elevated relative to the toes and the ball of the foot when the foot is planted. This arrangement leads to improper walking posture, which can lead to injury, and detracts from the wearer's walking power and walking speed. Because of the forwardly declining orientation of the wearer's foot, the wearer will tend to stand with a body reclined slightly so as to maintain balance. This results in an unhealthy posture and increases the likelihood of injury to the walker's lower torso. Conventional shoes also detract from walking efficiency because it is necessary to provide a sole with an undersurface which is generally planar from the shoe's heel to the tip of its toe. Such a planar surface is made necessary in order to provide a walker adequate balance while providing a motive force and bending the forepart of the shoe. However, during fast walking, planar shoes may be uncomfortable and may place stress on the Achilles tendon.

SUMMARY OF THE INVENTION

According to one aspect of the present invention, a walking shoe includes a segmented midsole with a thickness that changes from back to front. The midsole includes a back portion and an arcuate front portion. The arcuate front portion interfaces with the back portion and includes a plurality of forward sections. At least one of the forward sections differs in density relative to another of the forward sections. Relatively denser forward sections facilitate a rebound or spring effect as a walker pushes off during a walking stride. Relatively less dense forward sections add cushioning, making the walking stride more comfortable by lessening impact to the walker's foot.

DETAILED DESCRIPTION OF THE INVENTION

Figure 1:
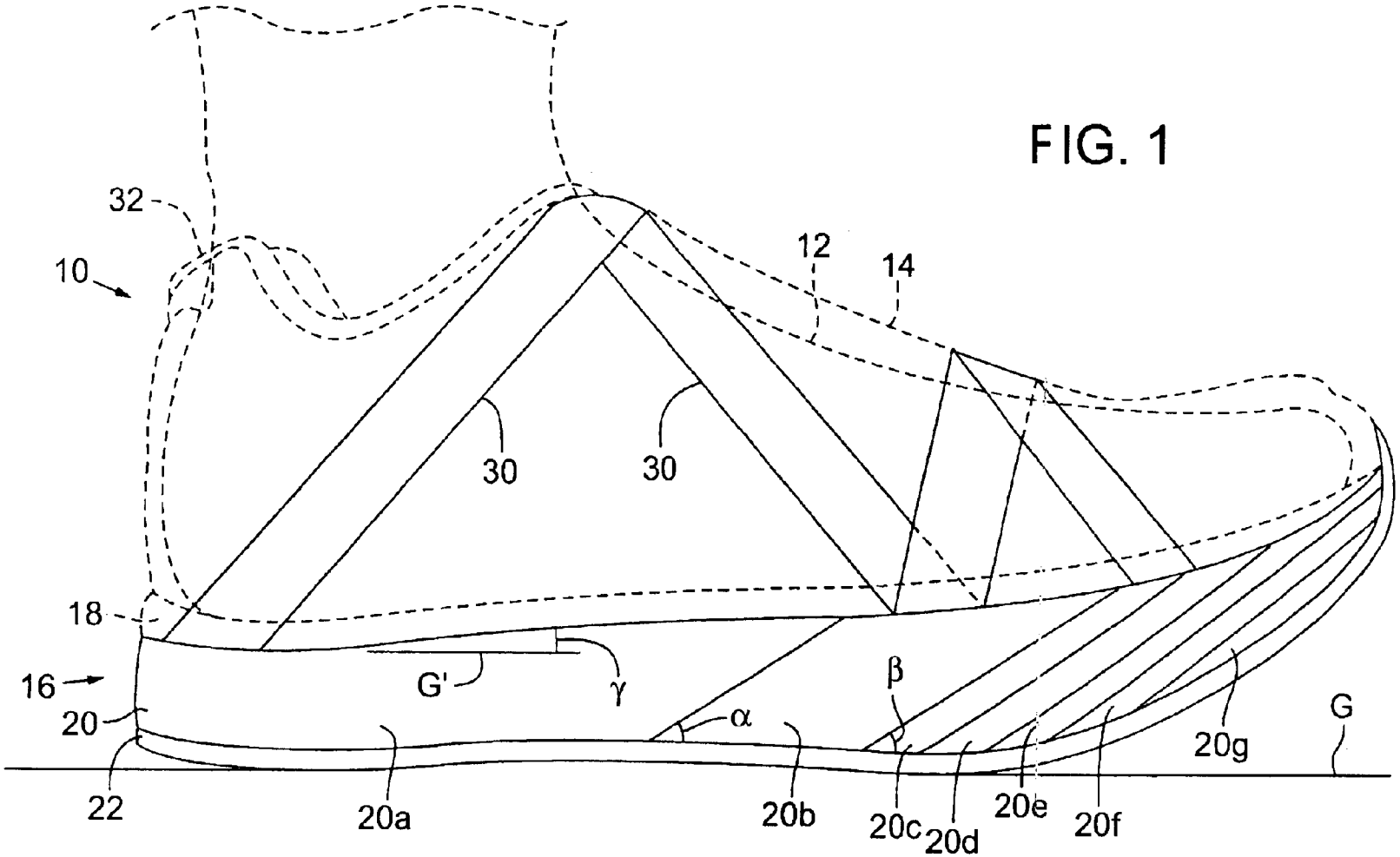
FIG. 1 is a side elevational view of a shoe formed in accordance with one embodiment of the present invention, the shoe being shown in its planted orientation relative to the ground.

As stated above, the present invention relates to a new walking shoe, which is constructed to promote optimal cushioning and rebound or spring. Although useful during various walking exercises, the invented shoe has demonstrated particular utility in the sport of race walking and is described in the context of a race walking shoe below. It is to be appreciated, however, that the shoe may be adapted for use in the context of virtually any walking shoe style.

Turning now to the drawings, and referring specifically to FIG. 1, the reader will note that a shoe formed in accordance with the present invention is shown generally at 10. Shoe 10 is designed to receive a foot 12 (shown in dashed lines), and includes an upper 14 (also shown in dashed lines) and a sole 16. The shoe's upper may be similar in form to a conventional athletic shoe upper, but is shown in the present embodiment to incorporate a unique strapping arrangement 30.

The upper may be constructed of canvas, leather, nylon, mesh, spandex or some other material, or combination of materials, suitable for use in the manufacture of walking or sport shoes. The upper envelopes the wearer's foot, and the sole is secured to the upper so as to support the foot from below. The upper and sole may be combined by a conventional securement arrangement such as by an adhesive or stitching, arrangements which have proven effective in the past. The wearer's foot 12 thus may be held in place relative to shoe sole 16. This relative placement of the wearer's foot and the shoe sole may be enhanced by use of straps 30, or other fastening mechanisms such as laces or hook and loop straps.

Sole 16 is a unique dynamic design, characterized by inclusion of both a reverse heel and of an arcuately tapered toe, and designed to dynamically adjust during a walker's stride, so as to maximize comfort and efficiency. The sole is assembled of multiple horizontally extending sole layers which are combined to define the cooperative structure shown in FIG. 1. This structure is intended to improve the walking posture of the wearer's foot, a posture defined herein as the orientation of the foot relative to the ground. The structure is also intended to cushion impact on the wearer's foot and increase rebound or spring beneficial to the stride of the walker. The sole, as shown, includes an inner layer (or insole) 18, a middle layer (or midsole) 20, and an outer layer (or outsole) 22, the three usually being combined, such as by friction, adhesion, stitching, or another suitable method. The sole's dimensions are dependent on the shoe size, but are illustrated assuming a size 10½ men's shoe.

Insole 18 is that layer of the sole which most directly underlies the wearer's foot, extending substantially the length of the shoe to provide a bed on which the wearer's foot rests. The insole may include two or more distinct portions, such as a somewhat resilient rear portion generally underlying the wearer's heel, and a stiffer front portion generally underlying the wearer's forefoot and toes. In one embodiment, the rear portion is formed from a polyether polyurethane foam which absorbs impact and resists compression, and is typically on the order of approximately ⅜ inch thick. The front portion, however, may be stiffer to provide enhanced stability to the wearer's forefoot, and is typically on the order of approximately ⅛ inch to ¼ inch thick. As shown, the insole takes the form of a relatively thin wedge, but may alternatively be shaped to conform to the contours of a wearer's foot so as to provide additional foot support, such as by including a contoured arch support. Furthermore, the insole may be a separate, removable layer of the shoe's sole, or the uppermost layer of a unitarily formed midsole. There are times when a walker will wear these shoes to stand in. For that reason, the insole may be developed to provide heel height so a walker can stand in these shoes with a planar foot posture. In such cases, the insole material used in this application should not detract from the ability to facilitate forward momentum, as described below.

Outsole 22 may take the form of a thin sheet applied to the shoe's midsole along an expanse extending substantially the length of the shoe. The outsole, however, extends along the bottom of the midsole so as to provide a walking surface for the shoe. As indicated, the shoe's walking surface 22 may include a generally planar planting surface which extends from the rear of the shoe to an area underlying the ball of the wearer's foot, and a generally arcuate roll surface which extends from the area underlying the ball of the wearer's foot to the forward terminus of the shoe. This arrangement results from the shape of the shoe's midsole, such midsole defining the sole's overall thickness as will be described below. The shoe's outsole may be formed unitarily with the midsole, or more conventionally, may be attached to the midsole, such as by an adhesive.

Although not shown, it will be appreciated that outsole 22 may be provided with a tread design so as to improve traction of the shoe. It should also be appreciated that the outsole typically is formed from firm, stable material with frictional characteristics that facilitate adherence to the ground. A high density rubber, for example, is commonly used. Such a dense material will tend to extend shoe life, and will provide adequate protection for the wearer's foot.

SEGMENTED MIDSOLE

The shoe's midsole 20 includes multiple generally vertical extending sections, including a rear section 20*a*, a middle section 20*b*, and plural forward sections, such as 20*c*, 20*d*, 20*e*, 20*f*, and 20*g*, which constitute the midsole's front portion. Some or all of these sections may angle up from the back to the front of the shoe in an oblique orientation. The rear section may extend from the rear of the shoe (below the wearer's heel) to the shoe's instep (below the arch of the wearer's foot). The middle section may extend from the shoe's instep to the shoe's pivot (below the ball of the wearer's foot). The forward sections may collectively extend from the region generally surrounding the shoe's pivot to the forward termination of the shoe (beneath the wearer's toes). It is within the scope of the invention to alter the relative beginnings and endings of the respective sections to tailor to a particular type of activity and/or stride. In this sense, additional sections may be added, or illustrated sections may be combined. Similarly, the angle of the interface between sections may be altered or even reversed.

The shoe's midsole is intermediate the insole and outsole and defines the unique profile of the shoe. The rear section, middle section, and at least some of the forward sections usually extend from the insole to the outsole. Some of the forward sections, such as those nearest the front of the shoe (20*f* and 20*g* in embodiment shown), may extend from an area of the outsole to another area of the outsole, with a terminal forward section (such as 20*g*) typically collaterally disposed relative the outsole. The midsole's profile generally is consistent across the shoe's width and is characterized by a thickness, which is usually designed to be at a maximum in the general area of the sole below the ball of the wearer's foot. The sole's thickness will thus be understood to increase in a forward direction from that part of the sole which underlies the wearer's heel to that part of the sole which underlies the ball of the wearer's foot. Also, the sole's thickness decreases arcuately in the forward direction from the part of the sole underlying the ball of the foot to the forward terminus of the sole.

As shown, the rear section and the middle section constitute a back portion of the midsole. In some embodiments, the back portion may be a single integrated section, or the back portion may alternatively be further divided into additional sections. In the present embodiment, the interface between rear section 20*a* and middle section 20*b* of the midsole defines an angle $\alpha$ of approximately 25 to 40 degrees from the bottom surface of the sole. The back portion, via the corresponding rear section and middle section, increases in thickness in the forward direction, the inclined expanse thus extending between a first load-bearing area and a second load-bearing area. The first load-bearing area underlies the wearer's heel, and the second load-bearing area underlies the ball of the wearer's foot. These load-bearing areas, or points (in their simplest sense), optimally bear the bulk of the weight supported by a planted foot.

The shoe's forward sections constitute a front portion with a generally forwardly-decreasing thickness, collectively tapering arcuately to termination at the forward end of the shoe. This arrangement provides for improved planting of the foot as shown in FIG. 1, a smooth roll to the front of the foot, and improved push-off as will be described below. The front portion interfaces with the back portion, and in the illustrated embodiment, the interface between middle section 20*b* and forward section 20*c* of the midsole defines an angle β of approximately 25 to 40 degrees from the bottom surface of the sole, and the other collateral forward sections usually are similarly angled. This inclination has been selected so that when the walker's stride shifts into the push off phase, the length of the forward sections substantially underlie the front portion of the foot.

As shown, the front portion includes five forward sections, however, it is within the scope of the invention to include more than five forward sections, or alternatively only two to four forward sections. In some embodiments, a single forward section with an internally-graduating density may be used, alone or in combination with other forward sections. The forward sections are shown collaterally disposed in an oblique orientation relative the ground. The arcuate expanse extends between the second load-bearing area, generally under the ball of the foot, and the forward terminus of the sole. The sole thus defines a fulcrum or pivot generally below the ball of the wearer's foot, accommodating forward roll of the foot from the planted orientation (shown in FIG. 1) to the push-off orientation shown and described in U.S. Pat. No. 5,592,757 to Jackinsky, the subject matter of which is incorporated herein by this reference. The arcuate expanse underlies that portion of the foot which is used to push-off during walking, a feature which will be appreciated more fully upon reading further.

DIFFERENTIAL STIFFNESS

Importantly, it is to be noted that the midsole may be formed with differential stiffness characteristics, such as by forming the respective sections of the midsole with materials of different densities, thus providing a sole that dynamically changes during a walker's stride. For example, the midsole is shown to include a somewhat stiff rear section 20*a* (having a density of approximately 14–18 pounds per cubic feet (PCF)), a more cushioning middle section 20*b* (10–14 PCF), and a combination of cushioning and springing forward sections 20*c*, 20*d*, 20*e*, 20*f*, and 20*g* (respectively 13–17 PCF, 13–17 PCF, 18–22 PCF, 13–17 PCF, and 18–22 PCF). The plurality of forward sections are usually laminated together, such as by an adhesive. The connected nature of the plurality of forward sections increases the effectiveness of the cushioning, stabilizing, and springing attributes of the front portion of the midsole.

The forward sections with a lower relative density, such as 20*c*, 20*d*, and 20*f*, help provide cushioning and are therefore herein referred to as cushioning sections. In some embodiments, these section are positioned adjacent the middle section, under the ball of the foot. The cushioning sections are designed to compress under the ball of the foot as weight is shifted over the ball, which in turn temporarily flattens the plane of the reverse heel, thus helping alleviate any strain that may be placed on the Achilles tendon. As weight is transferred off of the ball of the foot, the cushioning sections rebound to their original shape, which helps maintain forward momentum.

The sections with a higher relative density assist in rebounding or springing the foot forward when pushing off, and thus are herein referred to as springing sections. The springing section(s) also help limit bending of the shoe and foot, which increases the surface area available for pushing off as the foot rocks over like a teeter-totter. The effect is akin to wearing swim fins in the water. Less bending of the foot also decreases friction, which in turn decreases heat and the chance of forming blisters. Furthermore, in some embodiments, a springing section may work in tandem with a cushioning section, thus providing a relatively stiff structure that may evenly compress the cushioning section and return energy from the rebound of the decompressing cushioning section to a walker's stride. It should be understood that the above densities are provided as an example, and that other densities may be used. In particular, the particular activity the shoe is designed for, the size and weight of the wearer, and the stride of the wearer may affect the densities that are chosen. Similarly, characteristics other than density may be utilized to increase either cushioning or springing.

Rear section 20*a* and middle section 20*b* may be formed from a material such as ethyl vinyl acetate, or another suitable material. Forward sections 20*c*, 20*d*, 20*e*, 20*g*, and/or 20*f* may be formed from a material such as polyether polyurethane (referred to generally as a "rebounding foam"). It will be appreciated, however, that other materials with similar rebounding, springing, and/or cushioning characteristics also may be used. Forward sections 20*e*–20*g* may each be sized approximately ⅛ inch to ¼ inch thick. Forward sections 20*c* and 20*d* may be sized in accordance with the overall size of the shoe, being thickened for larger feet, for example. Similarly, any of the forward sections may be subdivided into plural subsections (with similar or dissimilar densities), for example to tailor to a particular foot size, or some of the forward sections may be combined. Of course, it is within the scope of the invention to implement midsole sections of other dimensions and/or materials.

The Walking Shoe in Action

The shoe's use is intended for use in pairs, one shoe being placed on each of the wearer's feet. As previously described, walking consists of a series of steps, each step constituting a cycle wherein a walker shifts from a single support phase to a double support phase, and then back to the single support phase. In action during the single support phase, the walker's entire weight is balanced on one foot, the other foot being moved forward so as to move the walker into the double support phase. In the double support phase, the walker's weight is balanced between a leading foot and a trailing foot. The trailing foot is used to push the walker forward so as to again enter the single support phase, and begin the cycle anew. Push-off begins during the single support phase when the walker's center of gravity passes over the supporting foot.

With each step, an individual's forward foot lands on the heel, and transitions forward from the heel strike position to a planted position with the heel and ball of the foot supported from below by the ground. The differing densities of the sole serve to provide a smooth deceleration as the walker's weight shifts from the heel to the forefoot, providing stability and cushioning as the forefoot approaches the ground. As at least some of the sole compresses, energy is stored. The ball of the foot acts as a fulcrum, with the walker's foot pivoting forward about such fulcrum as the center of gravity passes thereover. Energy stored in the form of the compressed portion of the sole may then be released as the sole rebounds, thus keeping momentum in the walker's stride as the foot accelerates. This accommodates push-off with the trailing foot.

When a walker's foot is planted, as in the single support phase orientation shown in FIG. 1, the walker's weight rests on the shoe's planting surface, the principal components of the weight being distributed between the first and second load-bearing areas of the sole. These areas, it will be recalled, underlie the heel and ball of the wearer's foot respectively. The thickness of the sole in these areas is thus important in determining the posture of the wearer's foot when planted, the disparity in sole thickness defining the forward incline of the foot relative to the plane of ground G. The density of the sole also influences the stride. At the point of heel contact, the walker's foot is flexed and in an oblique position relative to the plane of the ground. Therefore, a reverse heel supports that position. As the walker's center of gravity shifts forward over the planted foot, the foot posture of the shoe also shifts to a planar position, helping limit strain to the Achilles tendon. As the walker toes off and begins the double support phase, the sole rebounds to its original position, causing a spring-like effect.

In the embodiment shown, the midsole's angle $\gamma$ of inclination is generally between 2 degrees and 6 degrees from the plane of the ground (shown as G'). The sole is thus intended to encourage forwardly-inclined planting of the wearer's foot. An incline angle of 5 degrees from the ground is preferably chosen, such angle having been recognized as an angle which encourages proper walking posture with a slight forward lean of the wearer's body. Those skilled will appreciate that such lean is encouraged by the present shoe in view of the shoe's forward incline, the wearer tending to lean forward so as to maintain balance. It will be noted, however, that alternative incline angles may be chosen in accordance with the desired speed of person wearing the shoe, height of the wearer, weight of the wearer, or other factors. Faster walkers, for example, will perform best with a shoe having an incline angle closer to 6 degrees, the greater angle accommodating improved rollover momentum and thus a faster walking speed. Slower walkers will be most comfortable in a shoe having an incline angle closer to 2 degrees, providing a shoe suitable for use during a more conventional walking pace.

Because proper walking technique requires heel-to-toe planting of the walker's foot, it should also be appreciated that use of the sole arrangement of the present invention will lead to earlier planting of the wearer's leading foot, and correspondingly, quicker push-off by the wearer's trailing foot. Once the leading foot is planted, the walker's forward momentum, in combination with the push-off force by the trailing foot, will tend to shift the walker's center of gravity forward. This allows the walker to begin push-off while still in the double support phase. As a result, the double support phase is shortened, substantially increasing the walker's speed.

The leading foot will eventually transition to a trailing foot, the walker's weight being pivoted about the area of the sole which underlies the ball of the wearer's foot. Due to the arcuate nature of the sole's front portion, bending of the shoe is minimized, allowing the walker to use the whole surface area of the foot to push off with. The arcuate taper also makes for a smoother transition to the shoe's push-off posture, and enhances the wearer's stability due to a rolling effect of the sole. Furthermore, the differing densities of the various portions of the midsole further enhance effectiveness of the shoe during planting of the foot, pivot of the foot, and corresponding push-off of the foot. For example, springing sections of the front portion collapse and then rebound to a biased uncompressed disposition, thus helping spring the foot forward. The cushioning sections help dampen impact to the metatarsals and/or other areas of the foot and may also be formed of rebounding materials that help return energy to the user upon compression. Of course, the springing sections may provide some cushioning effect and the cushioning sections may provide some springing or rebounding effect.

The strapping system 30, which typically is made with an elastic material such as neoprene, works in conjunction with the midsole by flexing and stretching in opposition to the midsole to enhance stability of the shoe. A more conventional fastening arrangement may be used, such as shoe laces, hook and loop straps, or an elastic slip-on upper. Combinations of these and other fastening arrangements may also be used. An ankle collar 32, made of a material such as spandex, may be secured to the shoe upper, and form-fit to the user's ankle to prevent rocks or other debris from entering the shoe.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

What is claimed is:

1. A shoe including a segmented midsole, the midsole comprising:

a rear section for supporting a heel of a foot;

a middle section for supporting a ball of the foot; and an arcuate front portion for supporting a front of the foot and for decreasing the thickness of the midsole from back to front, the front portion including plural collateral forward sections having oblique orientations;

wherein at least one of the forward sections has a relatively high density for providing spring, and another forward section has a relatively low density for providing cushioning.

2. The shoe of claim 1, wherein the rear section and the middle section interface at an angle in the range of 25 to 40 degrees.

3. The shoe of claim 1, wherein the middle section and the front portion interface at an angle in the range of 25 to 40 degrees.

4. The shoe of claim 1, wherein the rear section and the middle section incline at an angle of approximately 2 to 6 degrees, increasing the thickness of the midsole from back to front.

5. The shoe of claim 1, wherein the forward section with the relatively low density is situated immediately adjacent the middle section and extends from an insole to an outsole, and the forward section with the relatively high density is situated with at least one forward section intermediate the middle section and extends from one area of the outsole to another area of the outsole.

6. A shoe including an upper and an elongate sole that combines with the upper to provide support for a foot, the sole including a segmented midsole of varying thickness intermediate an insole and an outsole, the midsole comprising:

a rear section extending from the insole to the outsole for supporting a heel of a foot and for increasing the thickness of the midsole from back to front;

a middle section extending from the insole to the outsole for supporting a ball of the foot and for increasing the thickness of the midsole from back to front, wherein the middle section obliquely interfaces with the rear section; and an arcuate front portion that obliquely interfaces with the middle section for supporting a front of the foot and for decreasing the thickness of the midsole from back to front, the front portion including plural collateral forward sections having oblique orientations, wherein at least one forward section extends from the insole to the outsole and another forward section extends from one area of the outsole to another area of the outsole;

wherein at least one of the forward sections has a relatively low density for providing cushioning and another forward section has a relatively high density for providing forward spring.

7. The shoe of claim 6, wherein the forward section with the relatively low density is situated immediately adjacent the middle section and extends from the insole to the outsole, and the forward section with the relatively high density is situated with at least one forward section intermediate the middle section and extends from one area of the outsole to another area of the outsole.

8. The shoe of claim 6, wherein the rear section and the middle section interface at an angle in the range of 25 to 40 degrees.

9. The shoe of claim 6, wherein the middle section and the front portion interface at an angle in the range of 25 to 40 degrees.

10. The shoe of claim 6, wherein the rear section and the middle section incline at an angle of approximately 2 to 6 degrees, increasing the thickness of the midsole from back to front.

* * * * *